US007493866B2

(12) United States Patent
Fukao

(10) Patent No.: US 7,493,866 B2
(45) Date of Patent: Feb. 24, 2009

(54) THREAD TENSION DEVICE FOR SEWING MACHINE

(75) Inventor: Hiroaki Fukao, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 12/081,477

(22) Filed: Apr. 16, 2008

(65) Prior Publication Data

US 2008/0257243 A1 Oct. 23, 2008

(30) Foreign Application Priority Data

Apr. 17, 2007 (JP) ..... 2007-108186

(51) Int. Cl.
*D05B 47/00* (2006.01)
*D05B 73/00* (2006.01)

(52) U.S. Cl. ..... 112/254; 112/302; 112/259

(58) Field of Classification Search ..... 112/272, 112/258, 259, 254, 255, 302; 242/150 R, 242/419.4

See application file for complete search history.

(56) References Cited

U.S. PATENT DOCUMENTS 1,534,264 A * 4/1925 Hanson ..... 242/150 R
1,820,119 A * 8/1931 Chason ..... 242/150 R
2,701,694 A * 2/1955 Hamlett ..... 242/150 R
2,993,456 A * 7/1961 Herbst ..... 112/254
3,366,083 A * 1/1968 Ketterer et al. ..... 112/254
3,978,802 A * 9/1976 Hamlett ..... 112/254
4,694,765 A * 9/1987 Diehl ..... 112/254
5,265,548 A * 11/1993 Satoma ..... 112/254
5,611,499 A * 3/1997 Stokes et al. ..... 242/419.4
6,145,457 A 11/2000 Imaeda et al.
6,957,616 B1 * 10/2005 Chang ..... 112/254

FOREIGN PATENT DOCUMENTS

JP A-56-097490 8/1981
JP A-06-134165 5/1994
JP A-2000-202182 7/2000
JP A-2001-327784 11/2001
JP B2-3314093 5/2002

* cited by examiner

*Primary Examiner*—Ismael Izaguirre
(74) *Attorney, Agent, or Firm*—Oliff & Berridge, PLC

(57) ABSTRACT

A thread tension device includes paired thread tension discs holding a needle thread, a thread tension spring biasing one of the discs toward the other, a thread tension dial adjusting a tension exerted on the needle thread, a spring force adjusting cam formed in the thread tension dial, a transfer plate following the cam so as to be capable of adjusting the spring force, and a first adjusting member threadingly engaged with the transfer plate to receive one end of the thread tension spring, a thread guide assembly having a through hole formed so that the adjusting tool is insertable into the through hole, and a second adjusting member rotatably mounted on the transfer plate and engageable with the distal end of the adjusting tool inserted into the through hole so as to be rotatable with the tool, thereby rotating the first adjusting member by rotation of the tool.

7 Claims, 11 Drawing Sheets

THREAD TENSION DEVICE FOR SEWING MACHINE

CROSS-REFERENCE TO RELATED APPLICATIONS

This application is based on and claims the benefit of priority from the prior Japanese Patent Application No. 2007-108186, filed on Apr. 17, 2007, the entire contents of which are incorporated herein by reference.

BACKGROUND

1. Field

The present invention relates to a sewing machine, and more particularly to a thread tension device therefor including a thread tension dial which is manually turned by an operator so that a tension applied to a needle thread clamped between a pair of thread tension discs is adjusted.

2. Related Art

Conventional lockstitch sewing machines are provided with a thread tension device in a sewing arm. The thread tension device includes a thread tension dial for adjusting the strength of tension applied to a needle thread. The thread tension dial has an upper end partially exposed outward from an upper part of the sewing arm, so as to be externally operable. When workpiece cloth is to be sewn, an operator manually turns the thread tension dial according to a thickness and type of the workpiece cloth and a type of the sewing thread. As a result, the operator can adjust the strength of tension applied to the needle thread.

For example, a publication JP-A-H06-134165 discloses a threading error proofing device for a sewing machine. A vertical display panel is mounted on an upper front interior of the sewing arm. A needle thread tension mechanism is provided right behind the display panel. The thread tension mechanism comprises needle thread tension discs, a tension release bar, a thread tension adjusting member, a needle thread tension spring and a spring seat. The tension release bar is provided for opening and closing the thread tension discs. The needle thread tension spring is provided between the needle thread tension discs and the thread tension adjusting member to bias the needle thread tension discs in a closing direction. The spring seat receives an end of the needle thread tension spring.

The needle thread tension mechanism is thus disposed right behind an exterior cover inside the sewing arm. When a test operation of a sewing machine is carried out after assembly by a sewing machine manufacturer, tension applied to a needle thread is measured by setting the thread tension dial to a reference scale. In this case, when a measured value of tension applied to the needle thread differs from a reference adjustment value, the operator changes a magnitude of spring force of the needle thread tension spring, thereby setting the tension of the needle thread to the reference adjustment value. In this case, the operator needs to detach the exterior cover of the sewing arm and then manually turn the thread tension adjusting member receiving the right end of the needle thread tension spring using an adjustment tool.

Thus, the operator needs to detach the exterior cover of the sewing arm and then turn the thread tension adjusting member using the tool when the magnitude of tension applied to the needle thread in the test operation differs from the reference adjustment value in the threading error proofing device described in the above-noted publication. As a result, detachment of the exterior cover is troublesome. Moreover, the thread tension adjusting member needs to be manually turned, whereupon a troublesome adjusting operation is necessitated. As a result, there is a problem that the adjusting work necessitates much time.

SUMMARY

Therefore, an object of the present disclosure is to provide a thread tension device which can easily and quickly carry out a work for adjusting the magnitude of a reference tension.

The present invention provides a thread tension device which is capable of adjusting a tension of a needle thread by an adjusting tool having a distal end, the thread tension device comprising a thread tension mechanism including a pair of thread tension discs holding the needle thread therebetween, a thread tension spring biasing one of the thread tension discs toward the other and having two ends, a thread tension dial adjusting a tension exerted on the needle thread by the thread tension discs subjected to a spring force of the thread tension spring, a spring force adjusting cam which is formed in the thread tension dial and is capable of adjusting the spring force of the thread tension spring, a transfer plate following the spring force adjusting cam so as to be capable of adjusting the spring force of the thread tension spring, and a first adjusting member which is threadingly engaged with the transfer plate to receive one end of the thread tension spring, a thread guide assembly provided with the thread tension mechanism, thread guide assembly having a through hole formed therethrough so that the adjusting tool is externally insertable into the through hole, and a second adjusting member rotatably mounted on the transfer plate and engageable with the distal end of the adjusting tool inserted into the through hole so as to be rotatable with the adjusting tool, thereby rotating the first adjusting member by rotation of the adjusting tool.

When the thread tension dial is turned by the operator, the spring force adjusting cam formed in the dial is also turned together with the dial. When the transfer plate is moved following the cam, the first adjusting member in threading engagement with the transfer plate is moved together with the transfer plate. Accordingly, the spring force of the thread tension spring provided between the thread tension discs and the first adjusting member is changed, whereupon the tension exerted on the needle thread is adjusted via the paired thread tension discs.

In a case where the thread tension dial assumes, for example, a turning position of dial scale "3" serving as a reference scale, the operator adjusts the spring force of the thread tension spring when the magnitude of the tension exerted on the needle thread differs from the adjustment reference value. In this case, the operator detaches a face plate covering the head of the sewing machine, inserting the distal end of the adjusting tool into the through hole formed in the thread guide assembly. While being engaged with the second adjusting member, the distal end of the adjusting tool is turned so that the second adjusting member is turned, whereupon the first adjusting member is turned with the second adjusting member. As a result, the spring force of the thread tension spring is increased or decreased.

In the above-described construction, when adjusting the magnitude of the tension at the reference position of the thread tension dial, the operator detaches the face plate covering the head of the sewing machine, inserting the distal end of the adjusting tool into the through hole formed in the thread guide assembly. The first adjusting member can be turned just when the distal end of the adjusting tool is turned while being engaged with the second adjusting member, so that the tension exerted on the needle thread can be adjusted easily and quickly. Furthermore, the adjusting work can be carried out quickly since the tension adjustment is performed by detaching the face plate which can generally be detached more easily than an external cover of the arm.

In one embodiment, the second adjusting member is disposed so that an imaginary rotation center line thereof is parallel with an imaginary rotation center of the first adjusting member and so that the second adjusting member is adjacent to the first adjusting member with a predetermined space therebetween; the first adjusting member has a first annular gear; and the second adjusting member has a second annular gear brought into mesh engagement with the first gear, an engagement recess engaged with the distal end of the adjusting tool, and a tapered guide formed at an entrance side of the engagement recess.

In the above-described construction, the distal end of the adjusting tool having been inserted into the through hole of the thread guide assembly is guided by the guide. Accordingly, the distal end of the adjusting tool can reliably be engaged with the engagement recess. Furthermore, the second adjusting member is turned by the mesh engagement of the second gear of the second adjusting member with the first gear of the first adjusting member, whereupon the first adjusting member is turned reliably and easily. Consequently, the tension adjusting work for the needle thread can greatly be simplified.

Furthermore, in another embodiment, the first adjusting member has a flange, and the second adjusting member has an outer peripheral groove engaging the flange. As the result of the construction, the second adjusting member can reliably be held in coupling with the first adjusting member by the engagement of the flange with the outer peripheral groove.

In further another embodiment, the flange of the first adjusting member has an outer peripheral surface formed with a knurling, the thread tension device further comprising a leaf spring member having one of two ends engaging the knurling and the other end fixed to the transfer plate. In this construction, the leaf spring and the knurling engage each other. As a result, the first adjusting member having the flange formed with the knurling can be prevented from inadvertent rotation during the sewing operation. Consequently, the tension exerted on the needle thread can reliably be prevented from variation due to rotation of the first adjusting member. Furthermore, the leaf spring and the knurling engage each other. Accordingly, rotation of a small concavo-convex portion of the knurling oscillates the leaf spring member upon turn of the first adjusting member in the tension adjusting work. As a result, the turn of the first adjusting member produces clicks. When confirming the clicks, the operator can easily determine turn of the first adjusting member.

The invention also provides a sewing machine comprising a thread tension device which is capable of adjusting a tension of a needle thread by an adjusting tool having a distal end, the thread tension device comprising a thread tension mechanism including, a pair of thread tension discs holding the needle thread therebetween, a thread tension spring biasing one of the thread tension discs toward the other and having two ends, a thread tension dial adjusting a tension exerted on the needle thread by the thread tension discs subjected to a spring force of the thread tension spring, a spring force adjusting cam which is formed in the thread tension dial and is capable of adjusting the spring force of the thread tension spring, a transfer plate following the spring force adjusting cam so as to be capable of adjusting the spring force of the thread tension spring, and a first adjusting member which is threadingly engaged with the transfer plate to receive one end of the thread tension spring, a thread guide assembly provided with the thread tension mechanism, thread guide assembly having a through hole formed therethrough so that the adjusting tool is externally insertable into the through hole, and a second adjusting member rotatably mounted on the transfer plate and engageable with the distal end of the adjusting tool inserted into the through hole so as to be rotatable with the adjusting tool, thereby rotating the first adjusting member by rotation of the adjusting tool, an arm in which the thread tension device is provided, the arm having an end, a pillar connected to the end side of the arm, a head provided at a side of the arm opposed to the pillar, an outer cover covering the arm and at least a part of the pillar, and a face plate detachably attachable to the head so as to be capable of accommodating the head, the face plate having a face opposed to the thread tension mechanism of the thread guide assembly formed with the through hole, said face being exposed when the face plate has been detached from the head.

In the above-described construction, the thread guide assembly of the thread tension device is exposed upon detachment of the face plate. Accordingly, when the tension of the needle thread is adjusted, the face plate is detached so that the through hole of the thread guide assembly is exposed. Thus, the tension exerted on the needle thread can be adjusted when only the face plate which can be detached easier is detached without detachment of the outer cover. Consequently, the adjusting work can be carried out quickly.

BRIEF DESCRIPTION OF THE DRAWINGS

Other objects, features and advantages of the present disclosure will become clear upon reviewing the following description of embodiments with reference to the accompanying drawings, in which.

DETAILED DESCRIPTION

Figure 1:
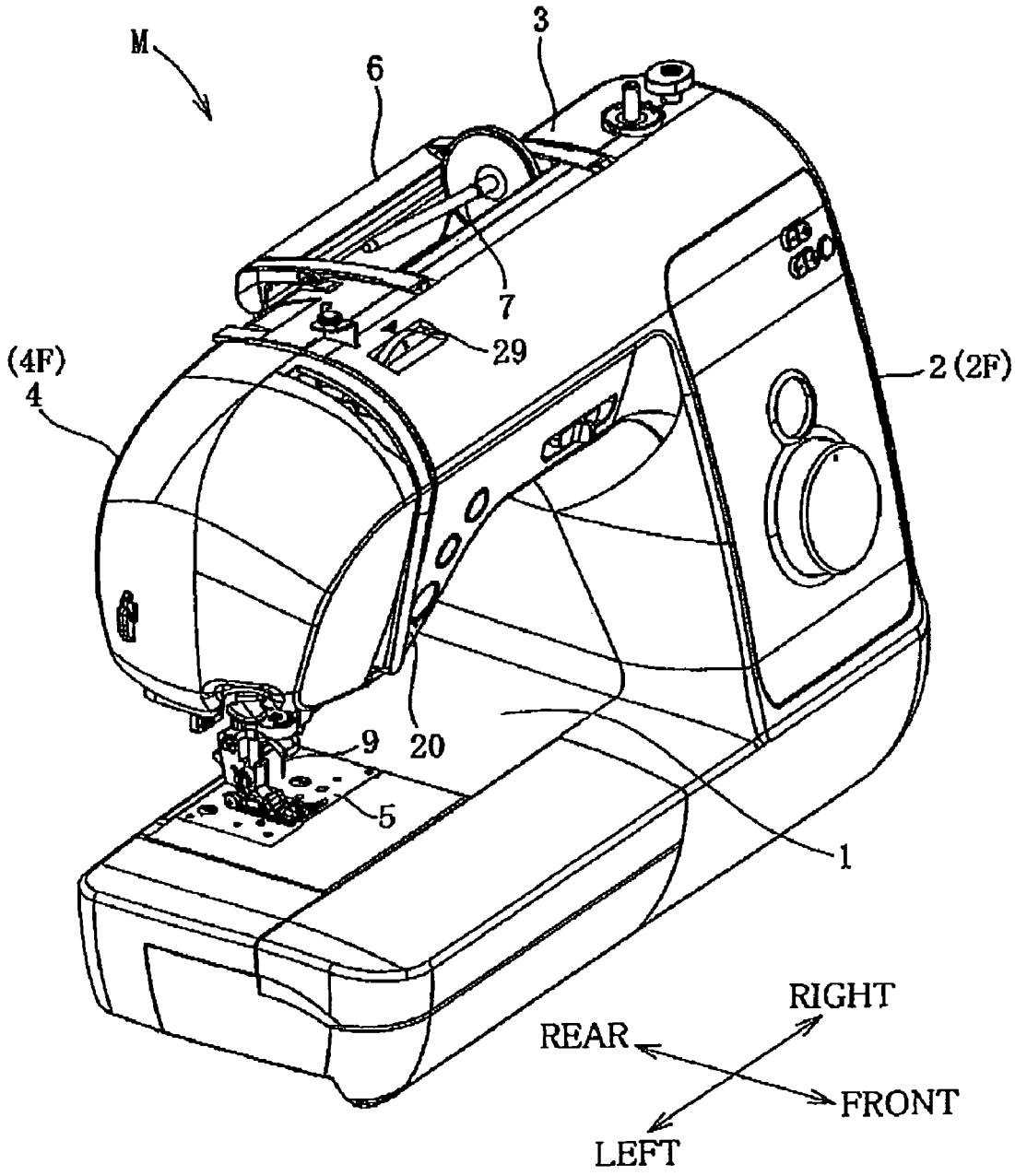
FIG. 1 is a perspective view of an electronic sewing machine provided with a thread tension device of one embodiment in accordance with one example.
Figure 2:
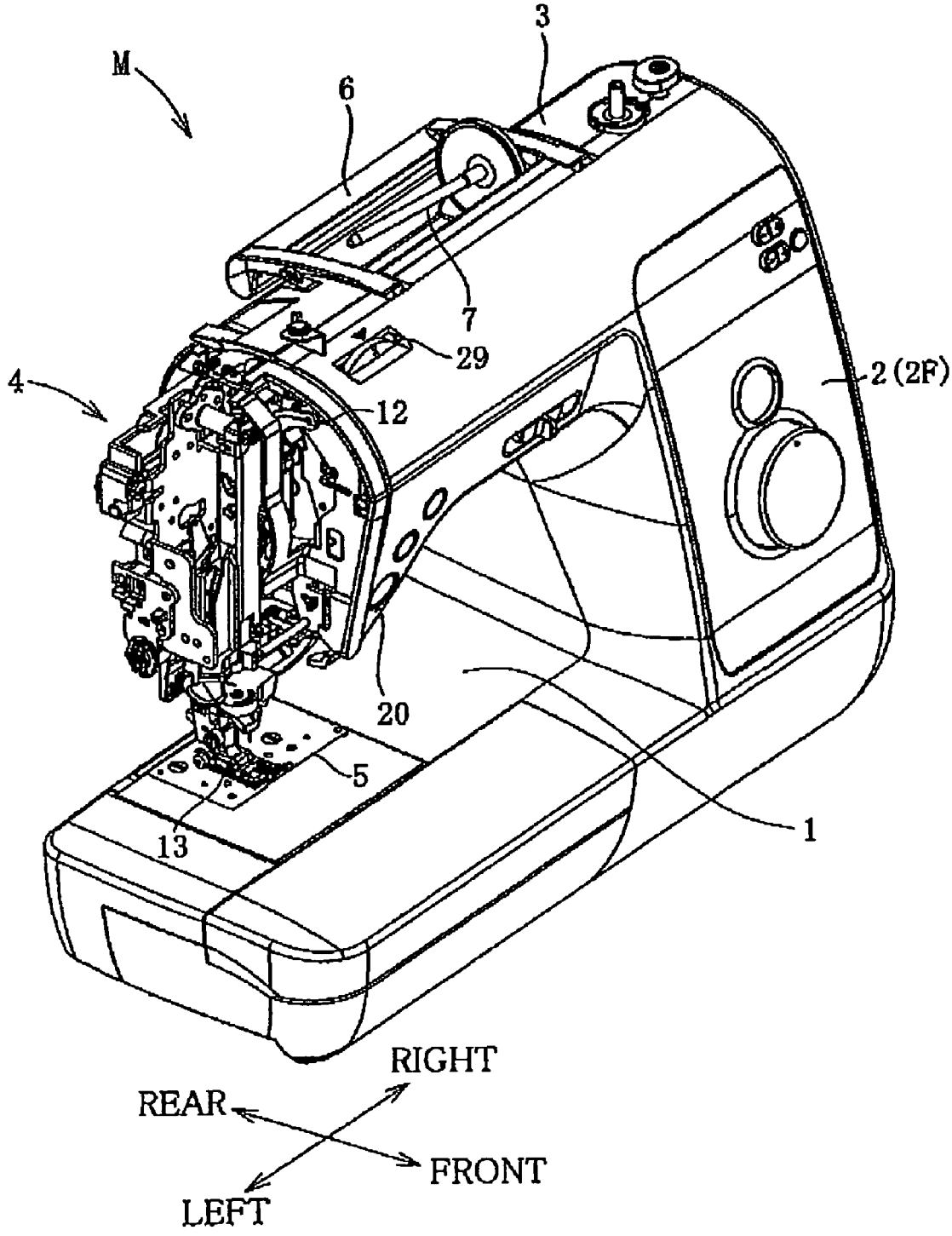
FIG. 2 is a perspective view of the electronic sewing machine with a face plate being detached.

One embodiment will be described with reference to the accompanying drawings. Referring to FIGS. 1 and 2, an electronic sewing machine M with which the thread tension device of the embodiment is provided is shown. The electronic sewing machine M includes a bed 1, a pillar 2, an arm 3 and a head 4. The pillar 2 stands from a right end of the bed 2, and the arm 3 extends leftward from an upper end of the pillar 2 so as to be opposed to the bed 1. The head 4 is provided on a left part of the arm 3. The pillar 2 and the arm 3 have respective fronts covered with an outer cover 2F. A thread tension dial 29 which will be described later is partially exposed from an upper left part of the arm 3 relative to the outer cover 2F, whereupon the thread tension dial 29 is manually operable. The head 4 is covered with a curved face plate 4F. FIG. 2 shows the electronic sewing machine M with the face plate 4F being detached. A needle plate 5 is provided on the bed 1. A thread cutting mechanism, a rotary hook (neither shown) and the like are provided below the needle plate 5. A bobbin (not shown) on which a bobbin thread is wound is detachably attached to the rotary hook.

Figure 3:
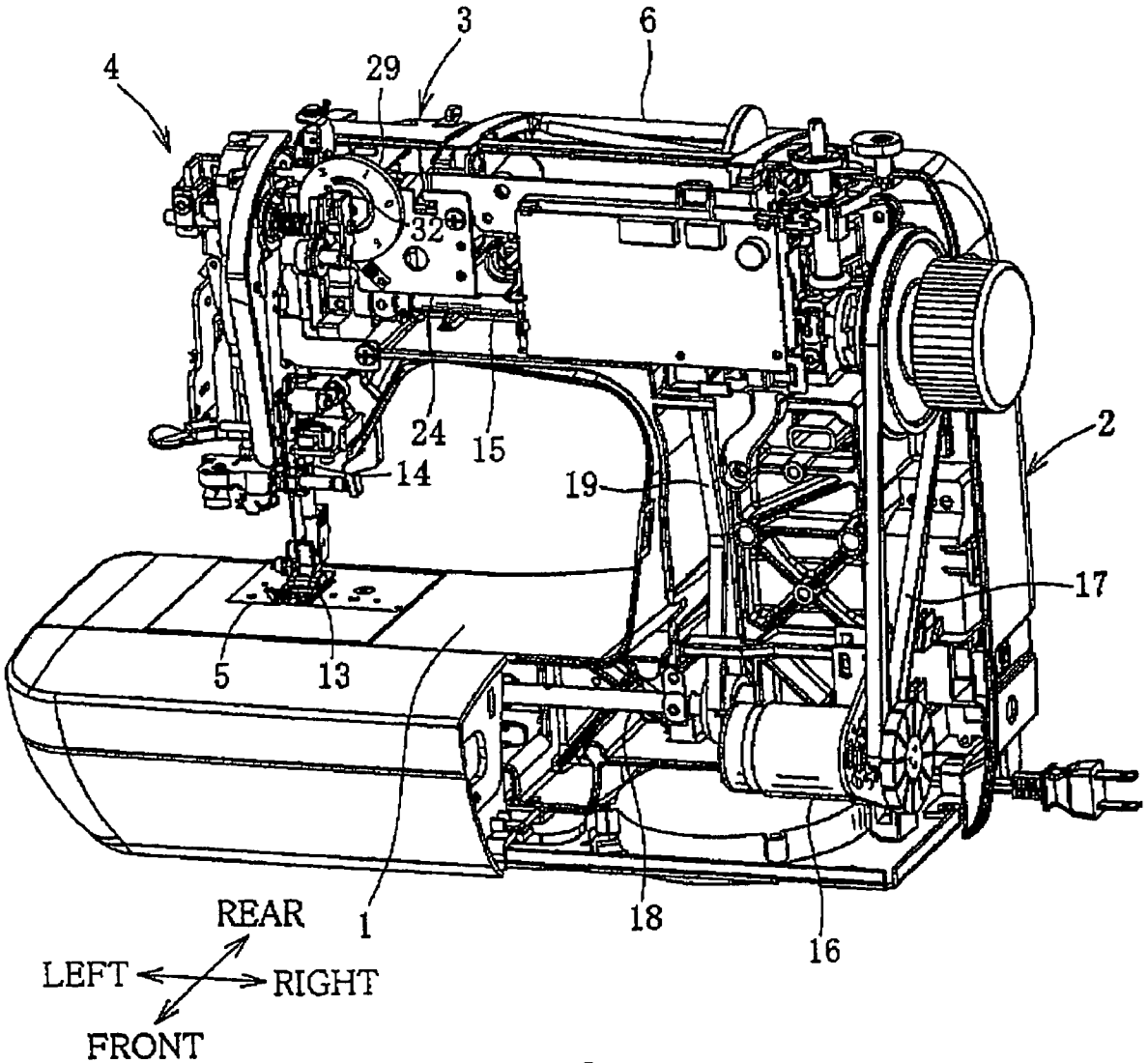
FIG. 3 is a perspective view of the electronic sewing machine with an outer cover and the face plate being detached.

A handle 6 has a proximal end which is pivotally mounted on a top of the arm 3. The handle 6 is gripped by an operator so that the electronic sewing machine M is carried. The top of the arm 3 is also formed with a thread spool accommodating recess in which a thread spool (not shown) is accommodated. A spool holder 7 is mounted in the accommodating recess so as to extend substantially horizontally. The thread spool is attached to the spool holder 7. A needle thread drawn from the thread spool is hooked along a predetermined thread guide path on a plurality of thread-hooking sections including a pair of thread tension discs 27*a* and 27*b* of the thread tension device 10, a thread take-up spring assembly 11, a needle thread take-up 12 and the like sequentially. The needle thread is finally inserted through an eye of the needle 9 attached to a lower end of a needlebar 14 as shown in FIG. 3. A start/stop switch 20 instructing start and end of sewing processing and other switches are provided on a lower front of the head 4.

FIG. 3 is a perspective view of the electronic sewing machine M with the outer cover 2F and the face plate 4F being detached. A main shaft 15 is disposed in the arm 3 as shown in FIG. 3. The main shaft 15 is rotated via a timing belt 17 by a sewing machine motor 16 provided on a lower end of the pillar 2. Upon rotation of the main shaft 15, the needlebar 14 mounted on the head 4 is vertically driven by a needlebar vertically moving mechanism (not shown) and the needle thread take-up 12 is vertically driven by a needle thread take-up driving mechanism (not shown). A lower shaft 18 provided in the bed 1 is rotated via a timing belt 19 in synchronization with the main shaft 15. As a result, the rotary hook is rotated by the lower shaft 18.

The thread tension device 10 will now be described. The thread tension device 10 has a thread tension mechanism 23 which will be described later and a thread guide assembly 24 for providing the thread tension mechanism 23. The thread guide assembly 24 will first be described in the following. The thread guide assembly 24 is formed into a generally L-shape as shown in FIGS. 4 to 7. The thread guide assembly 24 has a guide frame 24*a* and a thread tension plate 24*b* both formed integrally therewith. The guide frame 24*a* extends in a front-back direction and in a vertical direction. The thread tension plate 24*b* is connected to an upper end of the guide frame 24*a* and extends in a right-and-left direction.

The thread tension mechanism 23 comprises a thread tension shaft 26, the thread tension discs 27*a* and 27*b*, a spring force adjusting cam 30, a spring receiving member 31, a transfer plate 32, a first adjusting member 33, a through hole 24*c* defined therein and a second adjusting member 34. The thread tension shaft 26 is mounted on the guide frame 24*a*. The thread tension discs 27*a* and 27*b* are fitted on the thread tension shaft 26. A thread tension spring 28 is provided for exerting tension on the needle thread. A thread tension dial 29 is provided for adjusting the tension exerted on the needle thread. The spring force adjusting cam 30 is formed into a spiral shape and is located at the front side of the thread tension dial 29. The spring receiving member 31 is brought into contact with a left end of the thread tension spring 28 to support the end. The first adjusting member 33 is supported by the transfer plate 32. The through hole 24*c* is defined in the guide frame 24*a* of the thread guide assembly 24. The second adjusting member 34 is rotatably mounted via a support pin 35 on the transfer plate 32.

Figure 4:
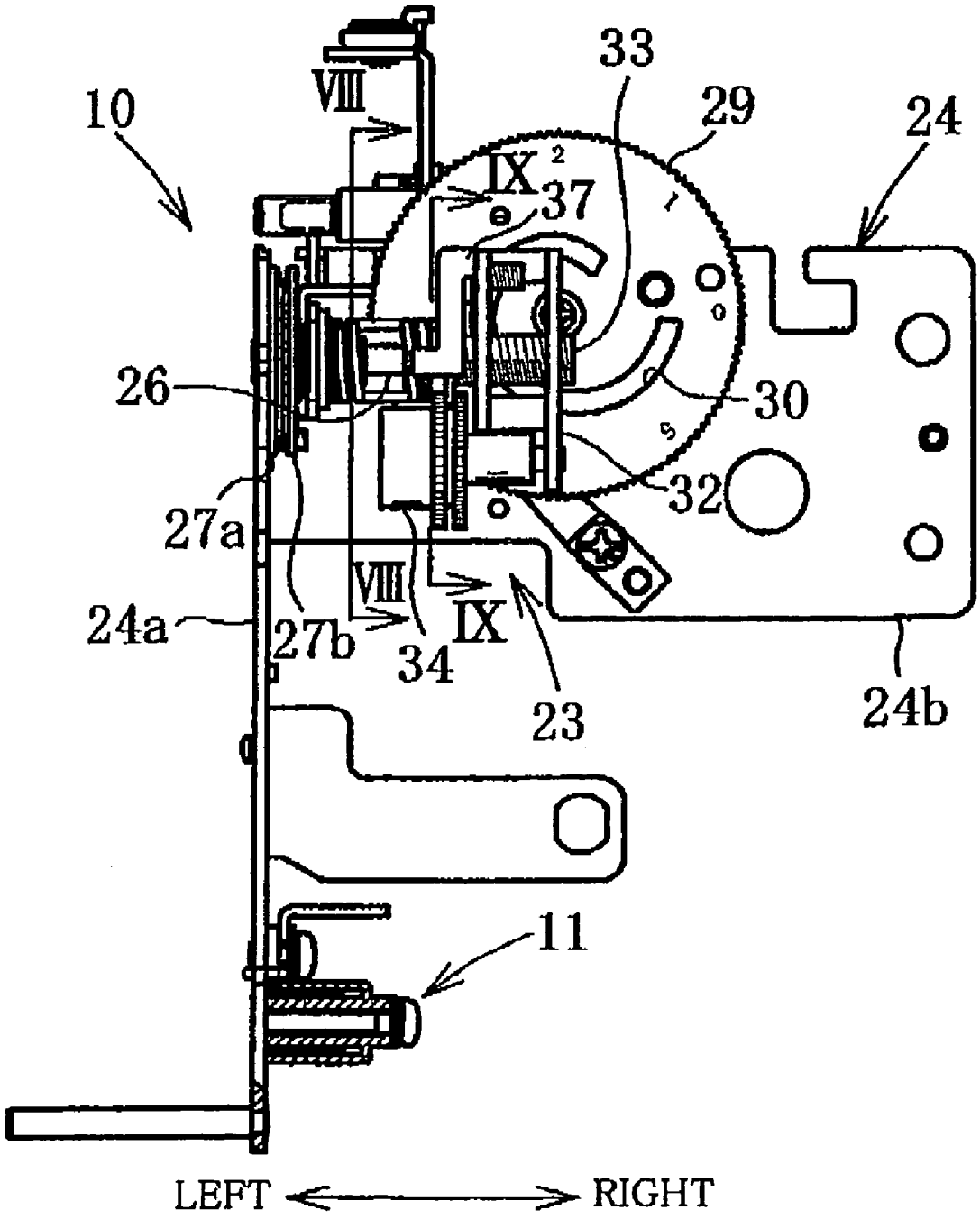
FIG. 4 is a front view of a thread guide assembly provided with a thread tension mechanism.
Figure 5:
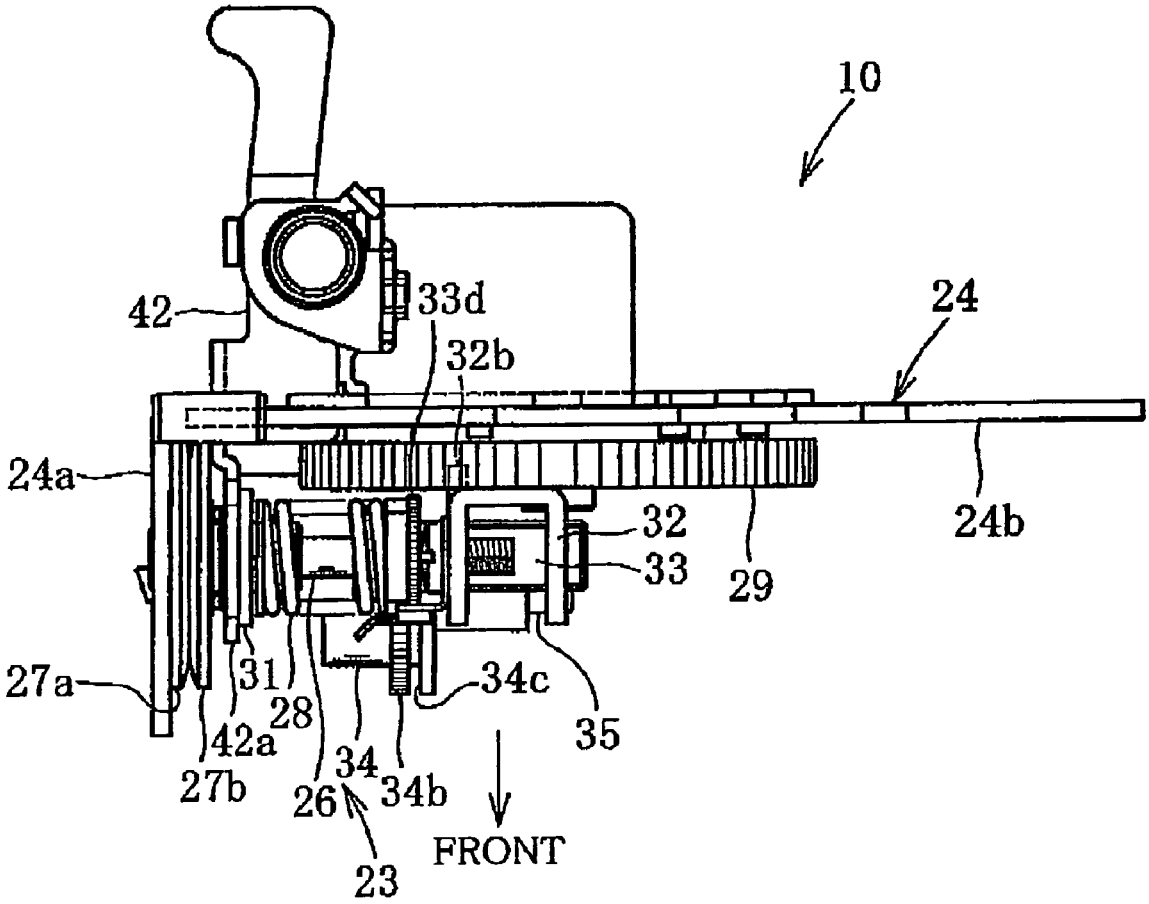
FIG. 5 is a front view of the thread guide assembly provided with the thread tension mechanism.
Figure 6:
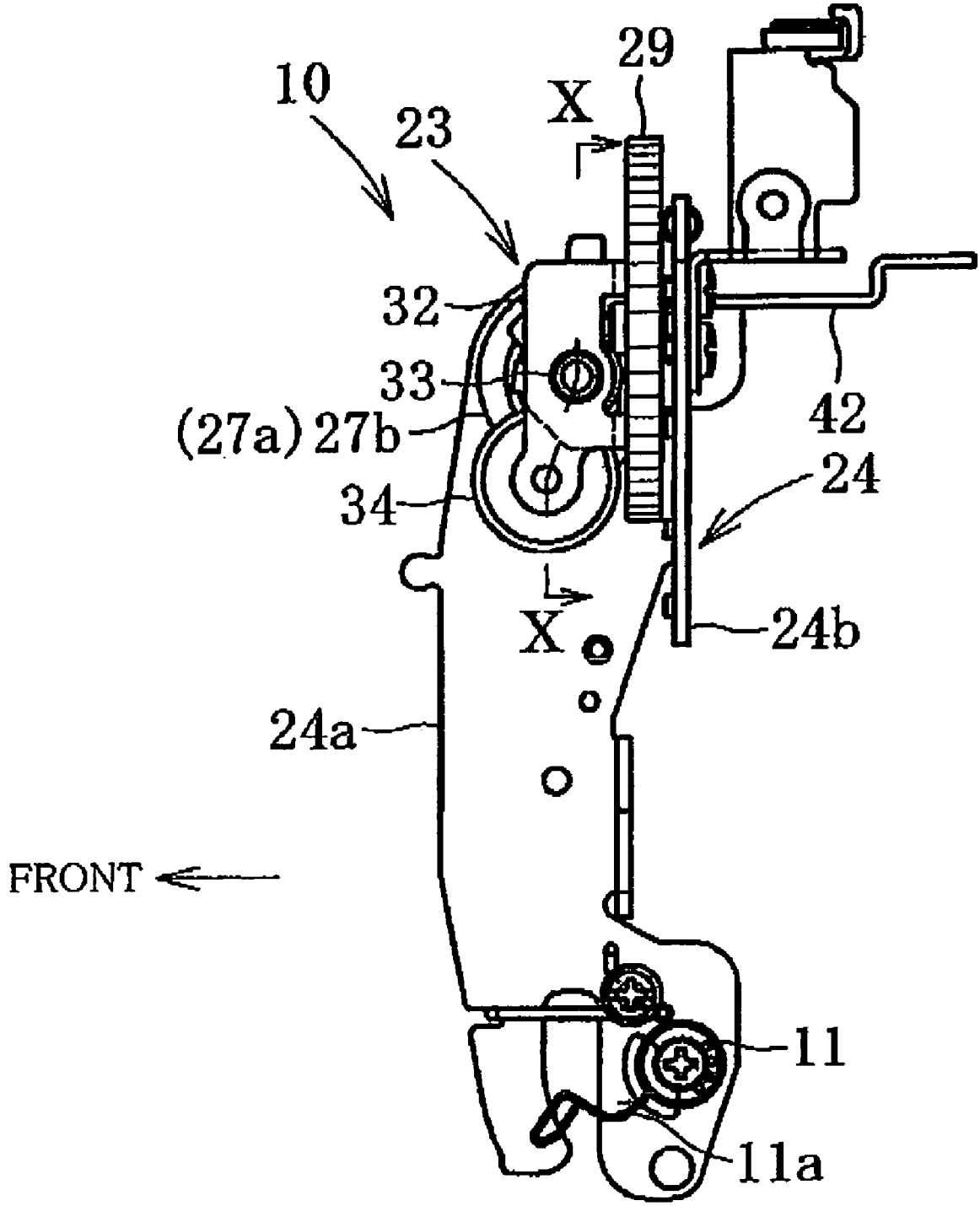
FIG. 6 is a right side view of the thread guide assembly provided with the thread tension mechanism.
Figure 9:
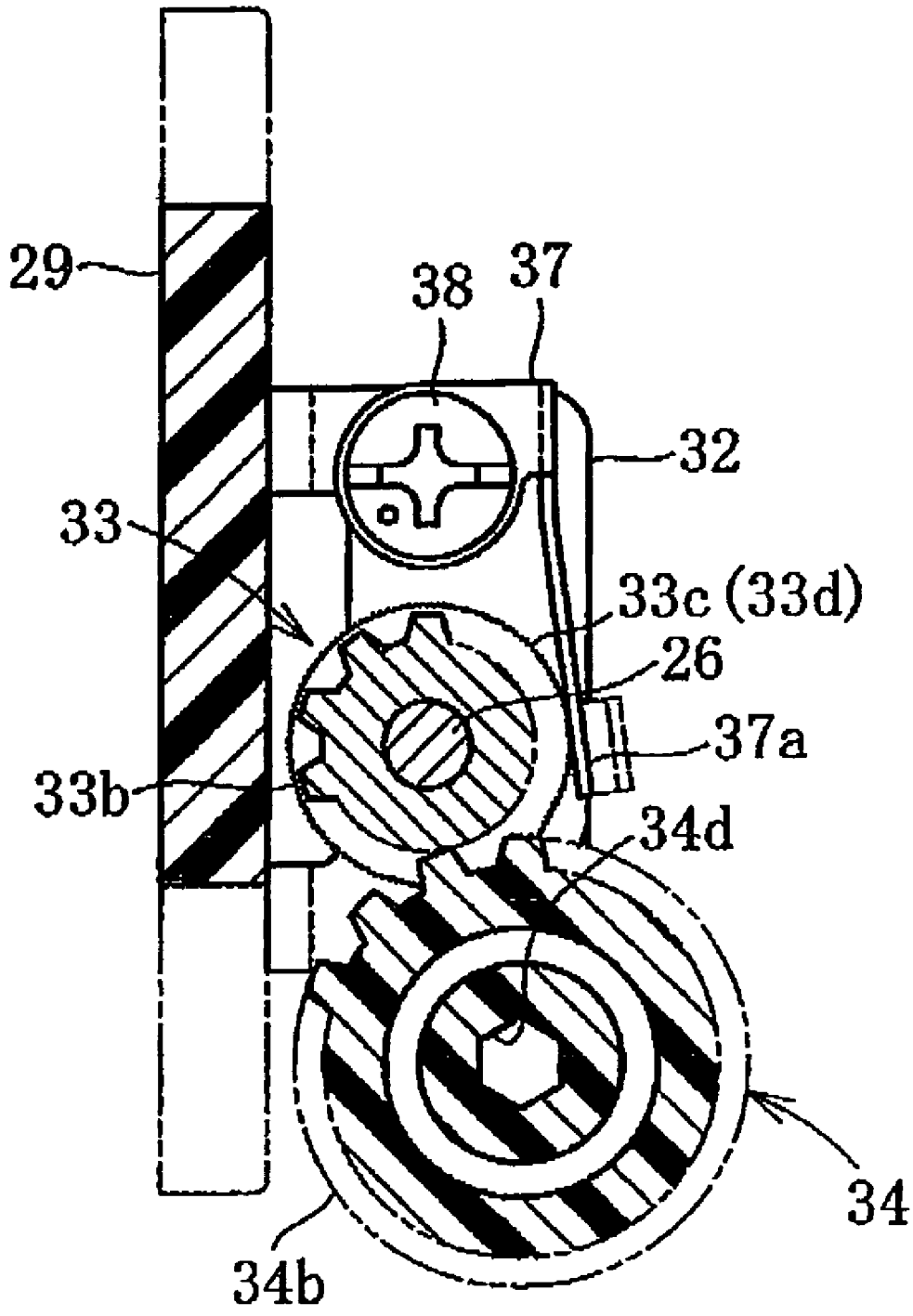
FIG. 9 is a longitudinal left side section taken along line IX-IX in FIG. 4.
Figure 10:
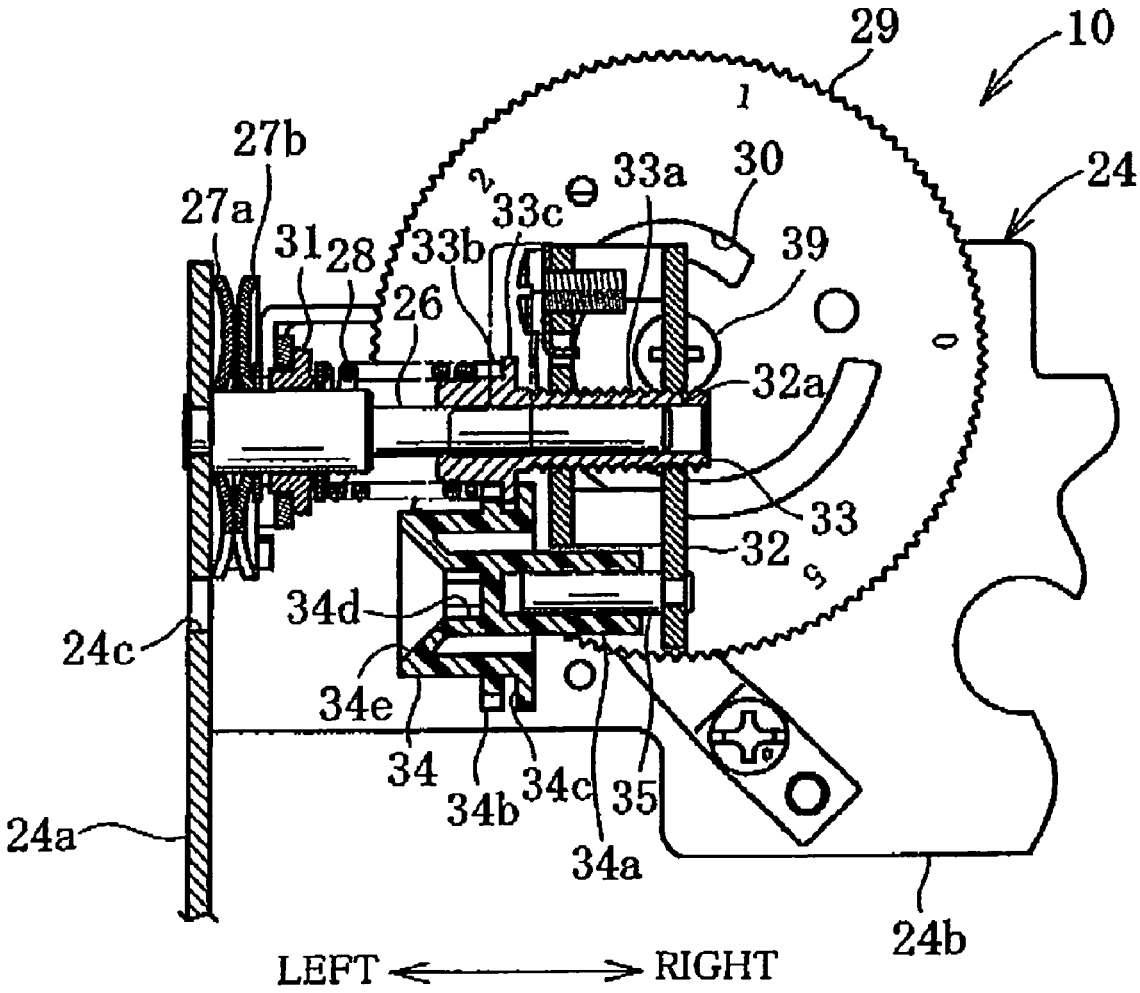
FIG. 10 is a longitudinal left side section taken along line X-X in FIG. 4.

The thread tension shaft 26 extends in the right-and-left direction and has a left end connected to an upper end of the guide frame 24*a* by caulking as shown in FIGS. 4, 5 and 10. The paired thread tension discs 27*a* and 27*b* and the spring receiving member 31 are mounted on a left end of the thread tension shaft 26. The first adjusting member 33 is mounted on a right end of the thread tension shaft 26. The first adjusting member 33 is formed into a generally circular cylindrical shape and has a male screw 33*a* comprising a right-hand thread formed on a substantially right half of an outer periphery. The male screw 33*a* is in threading engagement with a pair of right and left screw holes 32*a* formed in a heightwise middle of the transfer plate 32. The first adjusting member 33 is formed with a first gear 33*b* as shown in FIGS. 9 and 10 and has a flange 33*c* located just on the right of the first gear 33*b*. The flange 33*c* is slightly larger than an outer diameter of the first gear 33*b*. A knurling 33*d* is formed in an outer circumferential face of the flange 33*c* as shown in FIG. 5.

Figure 8:
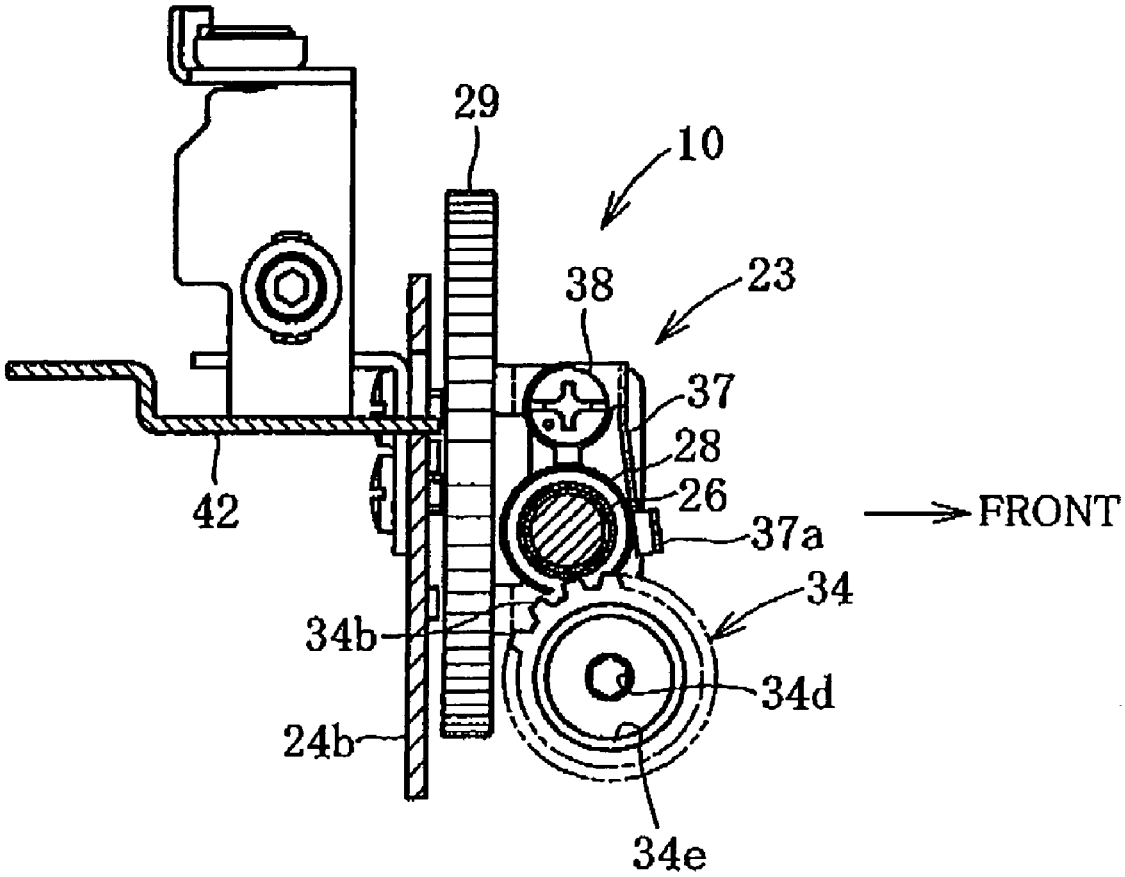
FIG. 8 is a longitudinal left side section taken along line VIII-VIII in FIG. 4.

A proximal end located in an upper end of a leaf spring member 37 is fixed by a fixing screw 38 to an upper end of the transfer plate 32 as shown in FIGS. 8 to 10. On the other hand, a distal end 37*a* located in a lower end of the leaf spring member 37 is formed with a horizontal convex portion (not shown). The convex portion of the distal end 37*a* is elastically biased so as to be in engagement with the knurling 33*d*. Accordingly, the first adjusting member 33 is prevented from inadvertent rotation due to oscillation or the like during a sewing operation as the result of engagement of the knurling 33*d* with the convex portion of the leaf spring member 37. Furthermore, upon rotation of the first adjusting member 33 in a tension adjusting work, rotation of the knurling 33*d* oscillates the leaf spring member 37, whereby an engagement portion between the knurling 33*d* and the leaf spring member 37 clicks.

The thread tension spring 28 is disposed between the left spring receiving member 31 and a spring receiving portion of the right first adjusting member 33. The spring receiving portion is located just on the left of the first gear 33*b* of the first adjusting member 33. The transfer plate 32 has a generally C shape as shown in FIGS. 3 and 5 and is supported on the thread tension shaft 26 via the first adjusting member 33 in threading engagement with the central screw hole 32*a* as described above, so as to be moveable in the horizontal direction along the thread tension shaft 26.

The thread tension dial 29 is formed into a circular shape and is mounted at the central part thereof on a front portion of the thread tension plate 24*b* by the fixing screw 39, so as to be rotatable. Numerals "0," "1," "2" and so on are printed on the front of the thread tension dial 29 so as to be located near an outer circumference of the dial 29. The numerals are arranged into an arc shape. The thread tension dial 29 further has a spiral spring force adjusting cam 30 as shown in FIGS. 4 and 10. The transfer plate 32 has an engagement protrusion 32*b* protruding rearward as shown in FIG. 5. The engagement protrusion 32*b* is located in front of the spring force adjusting cam 30 of the thread tension dial 29 and is brought into engagement with the cam 30.

The second adjusting member 34 is made from a synthetic resin and formed into a circular cylindrical shape. The second adjusting member 34 has a centrally located circular cylindrical support 34*a* extending rightward. The second adjusting member 34 also has a second gear 34*b* and an outer circumferential groove 34*c* both formed in an outer circumference thereof. The second gear 34*b* is brought into mesh engagement with the first gear 33*b*. The outer circumferential groove 34*c* is located just on the right of the second gear 34*b*. The circular cylindrical support 34*a* located on the left of a support pin 35 and is fitted onto the support pin 35. The support pin 35 is fixed to a lower end of the transfer plate 32. As a result, the second adjusting member 34 is rotatably mounted on the transfer plate 32 via the engagement of the circular cylindrical support 34*a* and the support pin 35. Thus, the second adjusting member 34 has an imaginary central line of rotation parallel to an imaginary central line of rotation of the first adjusting member 33 and is disposed close to the first adjusting member 33 with a predetermined gap therebetween.

Figure 7:
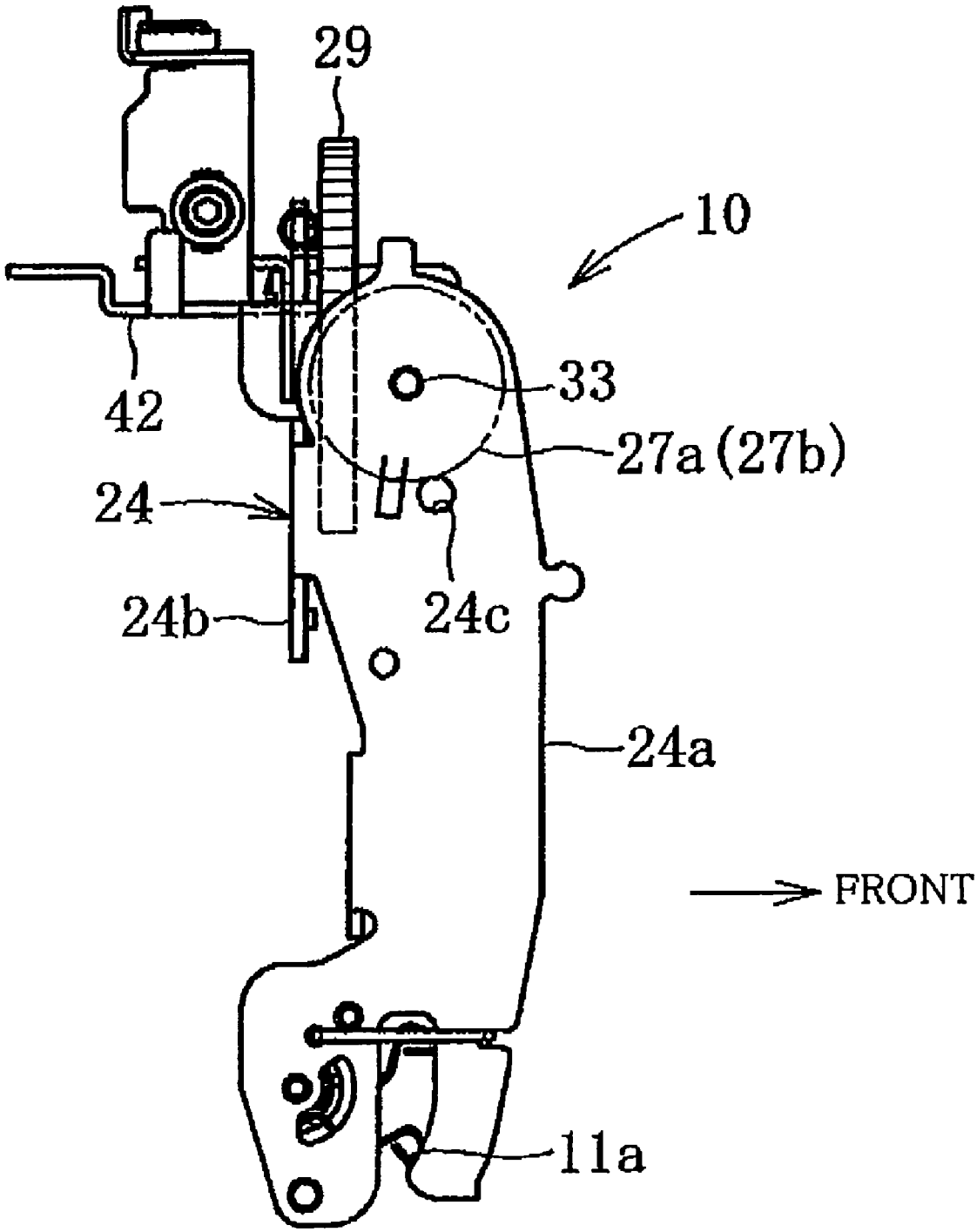
FIG. 7 is a left side view of the thread guide assembly provided with the thread tension mechanism.

The outer circumferential groove 34*c* located under the flange 33*c* of the first adjusting member 33 is in engagement with the flange 33*c* as shown in FIG. 10. Accordingly, the second adjusting member 34 is immovable in the direction of central line of rotation relative to the first adjusting member 33. As a result, upon rotation of the second adjusting member 34, the first adjusting member 33 is rotated via the second and first gears 34*b* and 33*b*. The second adjusting member 34 has an engagement recess 34*d* and a guide 34*e* as shown in FIG. 10. The engagement recess 34*d* is formed in the central inner part of the second adjusting member 34. A hexagonal wrench T serving as an adjusting tool has a distal end 37*a* brought into engagement with the engagement recess 34*d* from the left of the recess 34*d*. The engagement recess 34*d* has a hexagonal section with which the distal end 37*a* of the wrench T is engageable. The engagement recess 34*d* has a predetermined length in the direction of enter line of rotation. The guide 34*e* is formed into a tapered shape and connected to the left of the engagement recess 34*d* which is an entrance to the engagement recess 34*d*. The guide frame 24*a* has a through hole 24*c* which is formed therein so as to be opposed to the guide 34*e* as shown in FIGS. 7 and 10.

Figure 11:
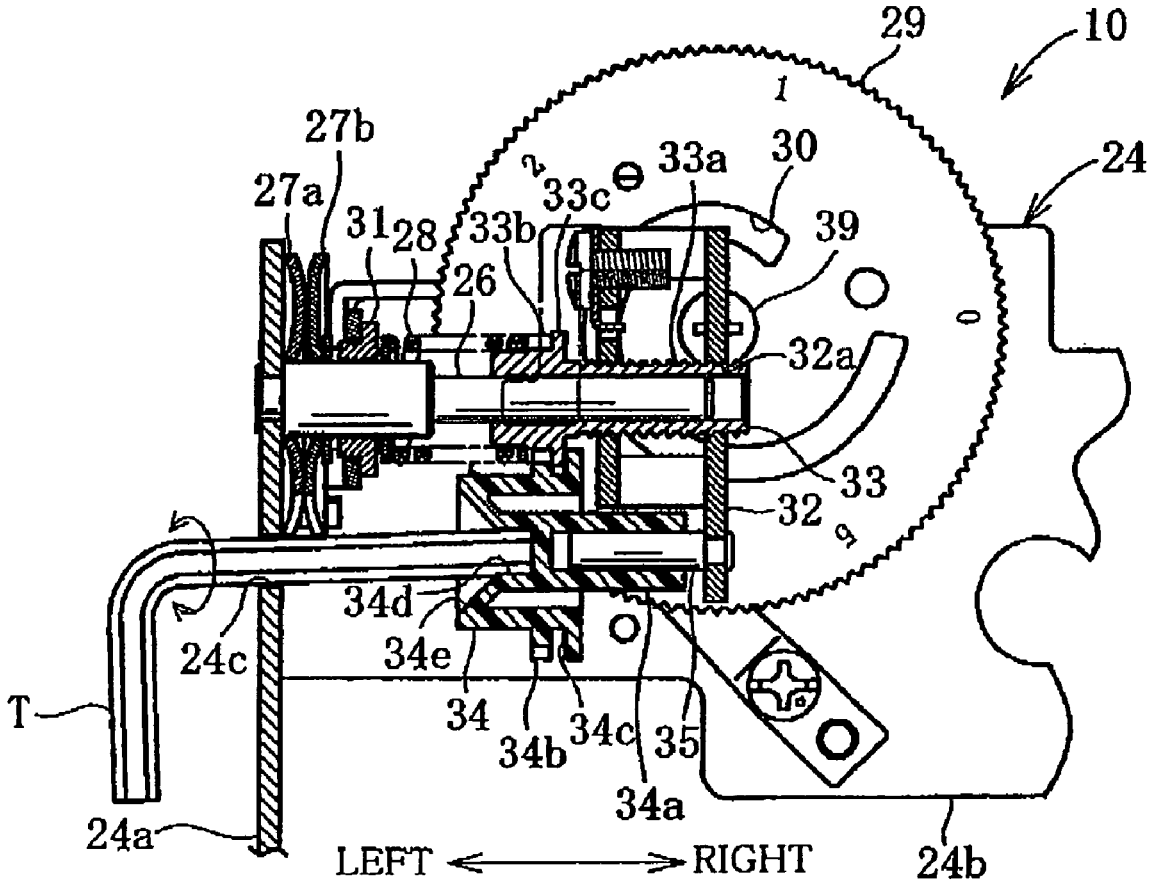
FIG. 11 is a view similar to FIG. 10, showing adjustment of thread tension by use of a hexagonal wrench.

The distal end 37*a* of the hexagonal wrench T serving as the adjusting tool is inserted through the hole 24*c* from the left side or an exterior of the thread guide assembly 24 to the right side or an interior of the thread guide assembly 24 as shown in FIG. 11. The inserted hexagonal wrench T is rotated so that a degree of tension exerted on the needle thread held between the thread tension discs 27*a* and 27*b* while the thread tension dial 29 assumes a reference position. A tension releasing lever 42 has a distal annular portion 42*a* which is provided on the thread tension shaft 26 of between the spring receiving member 31 and the thread tension disc 27*b* as shown in FIG. 5. More specifically, when a presser foot 13 as shown in FIG. 2 is moved upward, the tension releasing lever 42 is swung in association with the presser foot 13, whereupon the distal end annular portion 42*a* is moved rightward. Accordingly, since the thread tension disc 27*b* is released from the spring force of the thread tension spring 28, a gap is defined between the thread tension discs 27*a* and 27*b*. Consequently, the needle thread held between the paired thread tension discs 27*a* and 27*b* can be detached and different types of needle thread can be held between the thread tension discs 27*a* and 27*b*.

A thread take-up spring assembly 11 is provided on the lower end of the guide frame 24*a* as shown in FIGS. 4 and 5. The thread take-up spring assembly 11 biases the thread take-up spring 11*a* in a predetermined rotational direction. Since the thread take-up spring assembly 11 has a known structure, the description thereof will be eliminated.

The operation and advantages of the thread tension device 10 will be described. As shown in FIG. 10, the thread tension spring 28 is provided between the spring receiving member 31 and the first gear 33*b* of the first adjusting member 33. Accordingly, the thread tension disc 27*b* is pressed against the thread tension disc 27*a* by the spring force of the thread tension spring 28. As a result, tension is exerted on the needle thread held between the paired thread tension discs 27*a* and 27*b*. When the tension exerted on the needle thread is increased in the sewing of workpiece cloth, the operator turns the thread tension dial 29 clockwise. As a result, since the spring force adjusting cam 30 is gradually moves the engagement protrusion 32*b* leftward, the transfer plate 32 and the first adjusting member 33 in threading engagement with the transfer plate 32 are simultaneously moved leftward, following the engagement protrusion 32*b*. Consequently, the thread tension spring 28 is compressed such that the spring force of the thread tension spring 28 is increased. Accordingly, the tension exerted on the needle thread held between the thread tension discs 27*a* and 27*b* is increased.

On the other hand, when the tension exerted on the needle thread is reduced, the operator turns the thread tension dial 29 counterclockwise. As a result, since the spring force adjusting cam 30 is gradually moves the engagement protrusion 32*b* rightward, the transfer plate 32 and the first adjusting member 33 in threading engagement with the transfer plate 32 are simultaneously moved rightward, following the engagement protrusion 32*b*. Consequently, the thread tension spring 28 is released from the compressed state such that the spring force of the thread tension spring 28 is reduced. Accordingly, the tension exerted on the needle thread held between the thread tension discs 27*a* and 27*b* is reduced.

Next, the following describes a work for setting the degree of tension exerted on the needle thread to an adjustment reference value. Consider now the case where tension exerted on the needle thread between the thread tension discs 27*a* and 27*b* is larger than an adjustment reference value even when the scale of the thread tension dial 29 has been set to "3," for example. In this case, the tension exerted on the needle thread needs to be rendered weaker or smaller so as to be set to the adjustment reference value The operator then detaches from the head 4 the face plate 4F fixed thereto by several fixing screws as shown in FIG. 2. The operator further inserts the distal end 37*a* of the hexagonal wrench T into the through hole 24*c*, engaging the distal end 37*a* with the engagement recess 34*d* while the distal end 37*a* is being guided by the guide 34*e* of the second adjusting member 34.

The operator then turns the hexagonal wrench T counterclockwise while the distal end 37*a* of the hexagonal wrench T is in engagement with the recess 34*d*. As a result, the second adjusting member 34 is also turned counterclockwise, and the first adjusting member 33 in engagement with the second adjusting member 34 is turned clockwise. The first adjusting member 33 is in threading engagement with the transfer plate 32 via the male screw 33*a* which is a right screw. Accordingly, the first adjusting member 33 is moved rightward relative to the transfer plate 32 such that the thread tension spring is released from the compressed state. Consequently, the spring force of the thread tension spring 28 exerted on the needle thread between the thread tension discs 27*a* and 27*b* is rendered weaker or smaller.

Furthermore, consider now the case where tension exerted on the needle thread between the thread tension discs 27*a* and 27*b* is smaller than the adjustment reference value even when the scale of the thread tension dial 29 has been set to "3," for example. In this case, the tension exerted on the needle thread needs to be rendered stronger or larger so as to be set to the adjustment reference value. The operator then detaches the face plate 4F from the head 4 and further inserts the distal end 37*a* of the hexagonal wrench T into the through hole 24*c*. The operator engages the distal end 37*a* with the engagement recess 34*d* while the distal end 37*a* is guided by the guide 34*e* of the second adjusting member 34.

The operator then turns the hexagonal wrench T clockwise while the engagement recess 37*a* is in engagement with the engagement recess 34*d*. As a result, the second adjusting member 34 is also turned clockwise, whereas the first adjusting member 33 in engagement with the second adjusting member 34 is turned counterclockwise. The right screw or male screw 33*a* of the first adjusting member 33 is in threading engagement with the transfer plate 32. The first adjusting member 33 is moved leftward relative to the transfer plate 32, thereby compressing the thread tension spring 28. Consequently, since the spring force of the thread tension spring 28 is increased, the tension exerted on the needle thread between the thread tension discs 27*a* and 27*b* is rendered stronger or larger.

When the first adjusting member 33 is turned clockwise or counterclockwise, the knurling 33*d* oscillates the lead spring member 37 by turning. Accordingly, the contact between the knurling 33*d* and the leaf spring member 37 clicks. Consequently, the operator can reliably confirm rotation of the first adjusting member 33 by sound. Moreover, the leaf spring member 37 and the knurling 33*d* are engaged with each other when rotation of the first adjusting member 33 has been stopped. Accordingly, inadvertent rotation of the first adjusting member 33 can reliably be prevented during sewing.

As obvious from the foregoing, when the degree of tension at the reference position of the thread tension dial 29 is adjusted, the operator detached the face plate 4F covering the head of the electronic sewing machine M. The operator then engages the distal end of the hexagonal wrench T with the second adjusting member 34 via the through hole 24*c* formed in the thread guide assembly 24. When the hexagonal wrench T in engagement with the second adjusting member 34 is turned, the tension exerted on the needle thread by the turning of the first adjusting member 33 can be adjusted easily and quickly.

Furthermore, the second adjusting member 34 is disposed so that the center line of rotation thereof is in parallel with the centerline of rotation of the first adjusting member 33 and so that the second adjusting member 34 is close to the first adjusting member 33 with the predetermined gap being defined therebetween. Furthermore, the second adjusting member 34 has the engagement recess 34*d* and the guide 34*e*. Accordingly, the distal end of the hexagonal wrench T inserted into the through hole 24*c* is guided by the guide 34*e* and can reliably be engaged with the engagement recess 34*d*. The second gear 34*b* of the second adjusting member 34 is brought into mesh engagement with the first gear 33*b* of the first adjusting member 33. Consequently, upon rotation of the second adjusting member 34, the first adjusting member 33 is also rotated reliably and easily. Consequently, the work for adjusting the tension exerted on the needle thread can greatly be simplified.

The first adjusting member 33 is provided with the flange 33*c*. The second adjusting member 34 is formed with the outer circumferential groove 34*c* engaging the flange 33*c*. Accordingly, the first and second adjusting members 33 and 34 can reliably be maintained in a connected state by the engagement of the flange 33*c* and the outer circumferential groove 34*c*.

The knurling 33*d* is formed in the outer circumferential surface of the flange 33*c* of the first adjusting member 33. The distal end 37*a* of the leaf spring member 37 is in engagement with the knurling 33*d*. The proximal end of the leaf spring member 37 is fixed to the transfer plate 32. As the result of engagement of the leaf spring member 37 and the knurling 33*d*, the first adjusting member 33 having the flange 33*c* formed with the knurling 33*d* can reliably be prevented from inadvertent rotation during the sewing operation. Accordingly, the tension exerted on the needle thread can be prevented from variation during the sewing operation. Furthermore, when the first adjusting member 33 is rotated in the tension adjusting work, rotation of the knurling 33*d* oscillates the leaf spring member 37, whereupon the leaf spring member 37 clicks. When the operator confirms the clicking, the rotation of the first adjusting member 33 can reliably be determined.

Modified forms of the foregoing embodiment will now be described. The wrench having a hexagonal section is exemplified as the adjusting tool in the foregoing embodiment. However, the adjusting tool may have a section of square, plus (+), minus (−) or star shape. Thus, various shapes of adjusting tools may be used. In this case, the engagement recess 34*d* of the second adjusting member 34 is formed into a shape with which the adjusting tool is engageable.

The electronic sewing machine is described in the foregoing embodiment. However, the invention may be applied to various types of sewing machines other than the electronic sewing machine when the thread tension dial 29 is manually turned so that a degree of tension exerted on a needle thread is adjustable.

The thread tension device includes the thread tension dial 29 manually turned in the foregoing embodiment. However, the invention may be applied to an automatic thread tension device which comprises a thread tension gear formed with the spring force adjusting cam 30, a pulse motor driving the thread tension gear and a drive circuit controlling the pulse motor, instead of the thread tension dial 29 and in which a thread tension is automatically adjusted.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A thread tension device which is capable of adjusting a tension of a needle thread by an adjusting tool having a distal end, the thread tension device comprising:

a thread tension mechanism including:

a pair of thread tension discs holding the needle thread therebetween;

a thread tension spring biasing one of the thread tension discs toward the other and having two ends;

a thread tension dial adjusting a tension exerted on the needle thread by the thread tension discs subjected to a spring force of the thread tension spring;

a spring force adjusting cam which is formed in the thread tension dial and is capable of adjusting the spring force of the thread tension spring;

a transfer plate following the spring force adjusting cam so as to be capable of adjusting the spring force of the thread tension spring; and a first adjusting member which is threadingly engaged with the transfer plate to receive one end of the thread tension spring;

a thread guide assembly provided with the thread tension mechanism, thread guide assembly having a through hole formed therethrough so that the adjusting tool is externally insertable into the through hole; and a second adjusting member rotatably mounted on the transfer plate and engageable with the distal end of the adjusting tool inserted into the through hole so as to be rotatable with the adjusting tool, thereby rotating the first adjusting member by rotation of the adjusting tool.

2. The thread tension device according to claim 1, wherein:

the second adjusting member is disposed so that an imaginary rotation center line thereof is parallel with an imaginary rotation center of the first adjusting member and so that the second adjusting member is adjacent to the first adjusting member with a predetermined space therebetween;

the first adjusting member has a first annular gear; and the second adjusting member has a second annular gear brought into mesh engagement with the first gear, an engagement recess engaged with the distal end of the adjusting tool, and a tapered guide formed at an entrance side of the engagement recess.

3. The thread tension device according to claim 2, wherein the first adjusting member has a flange, and the second adjusting member has an outer peripheral groove engaging the flange.

4. The thread tension device according to claim 3, wherein the flange of the first adjusting member has an outer peripheral surface formed with a knurling, the thread tension device further comprising a leaf spring having one of two ends engaging the knurling and the other end fixed to the transfer plate.

5. The thread tension device according to claim 1, wherein the first adjusting member has a flange, and the second adjusting member has an outer peripheral groove brought into engagement with the flange.

6. The thread tension device according to claim 5, wherein the first adjusting member has an outer peripheral surface formed with a knurling, the thread tension device further comprising a leaf spring member having one of two ends engaging the knurling and the other end fixed to the transfer plate.

7. A sewing machine comprising:

a thread tension device which is capable of adjusting a tension of a needle thread by an adjusting tool having a distal end, the thread tension device comprising:

a thread tension mechanism including:

a pair of thread tension discs holding the needle thread therebetween;

a thread tension spring biasing one of the thread tension discs toward the other and having two ends;

a thread tension dial adjusting a tension exerted on the needle thread by the thread tension discs subjected to a spring force of the thread tension spring;

a spring force adjusting cam which is formed in the thread tension dial and is capable of adjusting the spring force of the thread tension spring;

a transfer plate following the spring force adjusting cam so as to be capable of adjusting the spring force of the thread tension spring; and a first adjusting member which is threadingly engaged with the transfer plate to receive one end of the thread tension spring;

a thread guide assembly provided with the thread tension mechanism, thread guide assembly having a through hole formed therethrough so that the adjusting tool is externally insertable into the through hole; and a second adjusting member rotatably mounted on the transfer plate and engageable with the distal end of the adjusting tool inserted into the through hole so as to be rotatable with the adjusting tool, thereby rotating the first adjusting member by rotation of the adjusting tool;

an arm in which the thread tension device is provided, the arm having an end;

a pillar connected to the end side of the arm;

a head provided at a side of the arm opposed to the pillar;

an exterior cover covering the arm and at least a part of the pillar; and a face plate detachably attachable to the head so as to be capable of accommodating the head, the face plate having a face opposed to the thread tension mechanism of the thread guide assembly formed with the through hole, said face being exposed when the face plate has been detached from the head.

* * * * *